US008397605B1

(12) United States Patent
Kao

(10) Patent No.: US 8,397,605 B1
(45) Date of Patent: Mar. 19, 2013

(54) RATCHET WRENCH

(75) Inventor: Chien-Chuan Kao, Taichung (TW)

(73) Assignee: John Metal Tools Industrial Ltd., Taichung (TW)

( * ) Notice: Subject to any disclaimer, the term of this patent is extended or adjusted under 35 U.S.C. 154(b) by 0 days.

(21) Appl. No.: 13/597,413

(22) Filed: Aug. 29, 2012

(51) Int. Cl.
*B25B 13/46* (2006.01)

(52) U.S. Cl. ..... 81/60; 81/58.1; 81/58.3

(58) Field of Classification Search ..... 81/60, 58.1, 81/58.3, 63.2
See application file for complete search history.

(56) References Cited

U.S. PATENT DOCUMENTS 6,681,660 B2 * 1/2004 Foard ..... 81/57.31
7,770,494 B2 * 8/2010 Cornwell et al. ..... 81/57.3

* cited by examiner

*Primary Examiner* — Monica Carter
*Assistant Examiner* — Melanie Alexander
(74) *Attorney, Agent, or Firm* — Charles E. Baxley

(57) ABSTRACT

A ratchet wrench includes a wrench body, a driving ratchet, a change-gear set, a retaining lid and a positioning rod. The driving ratchet is configured to removably engage with a tool part. In virtue of the cooperation between the change-gear set and the positioning rod, when the wrench body is turned toward a predetermined direction of the tool part, the driving ratchet can rotate in an increased speed, thereby improving the efficiency of operating the tool part.

9 Claims, 7 Drawing Sheets

RATCHET WRENCH

BACKGROUND OF THE INVENTION

1. Technical Field

The present invention relates to ratchet wrenches, and more particularly to a ratchet wrench having a change-gear set and a positioning rod that, when cooperating, drive a tool part in an increased speed.

2. Description of Related Art

For screwing a threaded part (e.g. a threaded bolt or a nut) to tight or loose, it is common to use an open-end wrench or a box wrench. However, for operation performed in spatially limited environments, using such a basic wrench can consume considerable time as the user has to repeatedly engage the wrench with the workpiece, rotate the wrench and remove the wrench from the workpiece. For improving the basic wrenches, ratchet wrenches have been developed to eliminate the need of repeated engagement and disengagement between the wrench and the workpiece. More particularly, a ratchet wrench uses a unidirectionally drivable ratchet so that it drives the workpiece when operated in one direction and runs idly without driving the workpiece when operated in the other direction, thereby simplifying and speeding up the overall operation.

Nevertheless, it is clear that in the operation of a conventional ratchet wrench the idle running in the non-driving direction is still a waste, so there is a room for improving the operational efficiency of the conventional ratchet wrenches.

In addition, Taiwan Patent No. M427237, titled "ROTATIONAL MECHANISM FOR HAND TOOL", discloses another wrench that has a turntable, a driving head and an accelerating wheel set positioned therebetween, so that when the turntable drives the driving head through the accelerating wheel set, the wrench can drive a workpiece in an increased speed. However, operation of such an existing wrench requiring a user to use his/her one hand to hold the turntable and use his/her the other hand to operate the same components is inconvenient and difficult to perform in confined operational space (e.g. in a vehicle's engine room).

SUMMARY OF THE INVENTION

As stated previously, the existing ratchet wrenches are not perfect for either lacking a design for accelerated operation or having a speed-changing mechanism that is structurally complicated and difficult to manufacture, fabricate and maintain. In view of the shortcomings, the objective of the present invention is to propose a ratchet wrench that uniquely uses a change-gear set and a positioning rod to drive a tool part in an increased speed.

The present invention provides a ratchet wrench that primarily comprises:

a wrench body, having a head portion and a shank, the head portion containing a ratchet socket that forms a first opening and a second opening at two reverse sides of the head portion connected by a channel;

a driving ratchet, having a wheel portion received in the ratchet socket and a connecting portion jutting out of the head portion through the first opening;

a change-gear set, having a passive gear mounted on an axle center of the wheel portion, a toothed periphery circling the channel, and a toothed driving ring deposited at the second opening, wherein the toothed driving ring has outer and inner peripheries thereof formed with outer teeth and inner teeth, respectively, and the outer teeth are configured to match the toothed periphery, while the inner teeth are configured to engage with the passive gear;

a retaining lid, rotatably covering the second opening, having a positioning recess for receiving the toothed driving ring, and having a positioning hole; and a positioning rod, being movably received in the positioning hole.

In operation, by using the positioning rod engaging with the positioning hole, the retaining lid is held still when the wrench body is rotated in a predetermined direction of the tool part, so relative rotation takes place between the retaining lid and the head portion, causing the toothed periphery to drive the toothed driving ring to rotate in the positioning recess, thereby driving the passive gear and the driving ratchet to rotate in the predetermined direction, while the speed-changing function of the change-gear set can speed up the driven rotation of the tool part.

BRIEF DESCRIPTION OF THE DRAWINGS

The invention as well as a preferred mode of use, further objectives and advantages thereof will be best understood by reference to the following detailed description of illustrative embodiments when read in conjunction with the accompanying drawings, wherein.

DETAILED DESCRIPTION OF THE INVENTION

Figure 1:
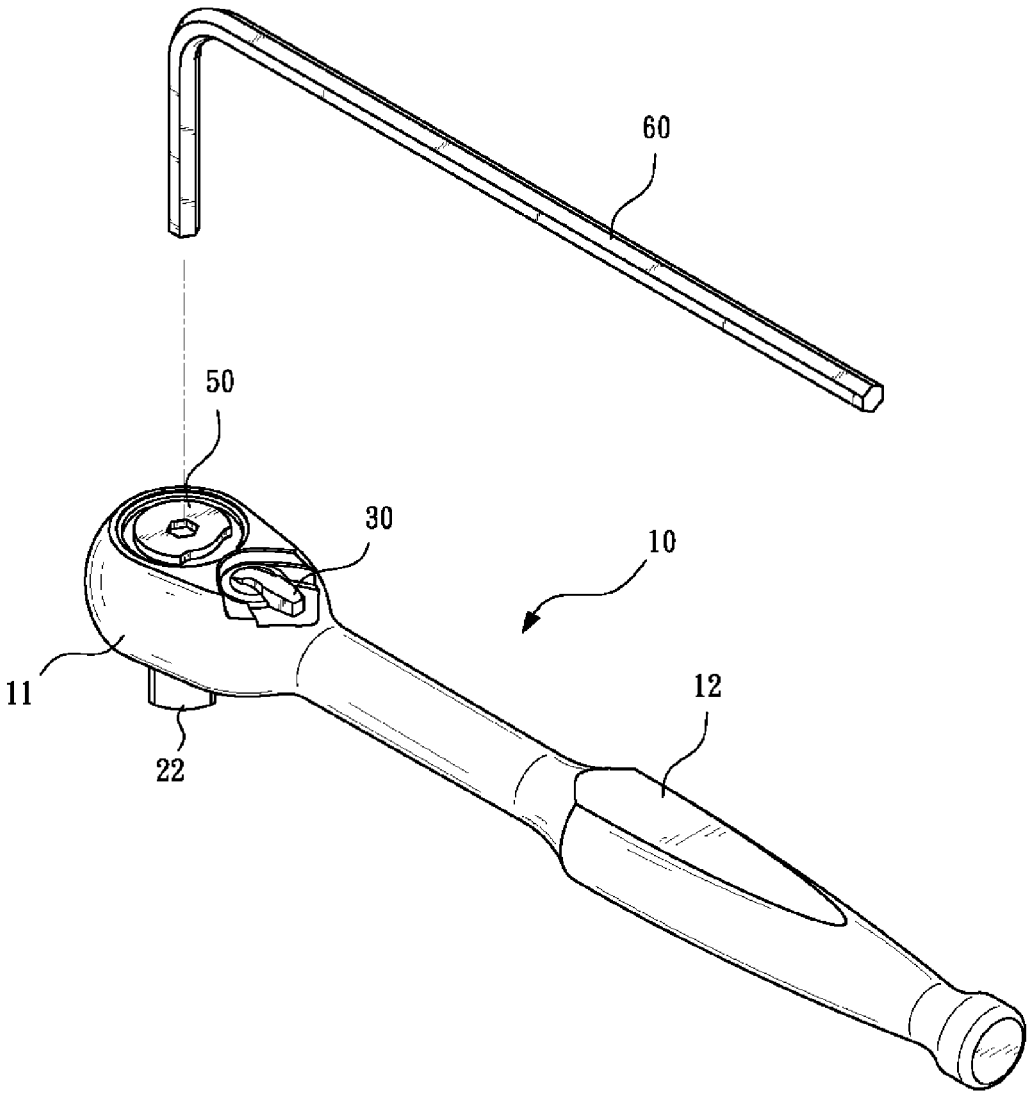
FIG. 1 is a perspective view of a ratchet wrench according to the present invention.
Figure 2:
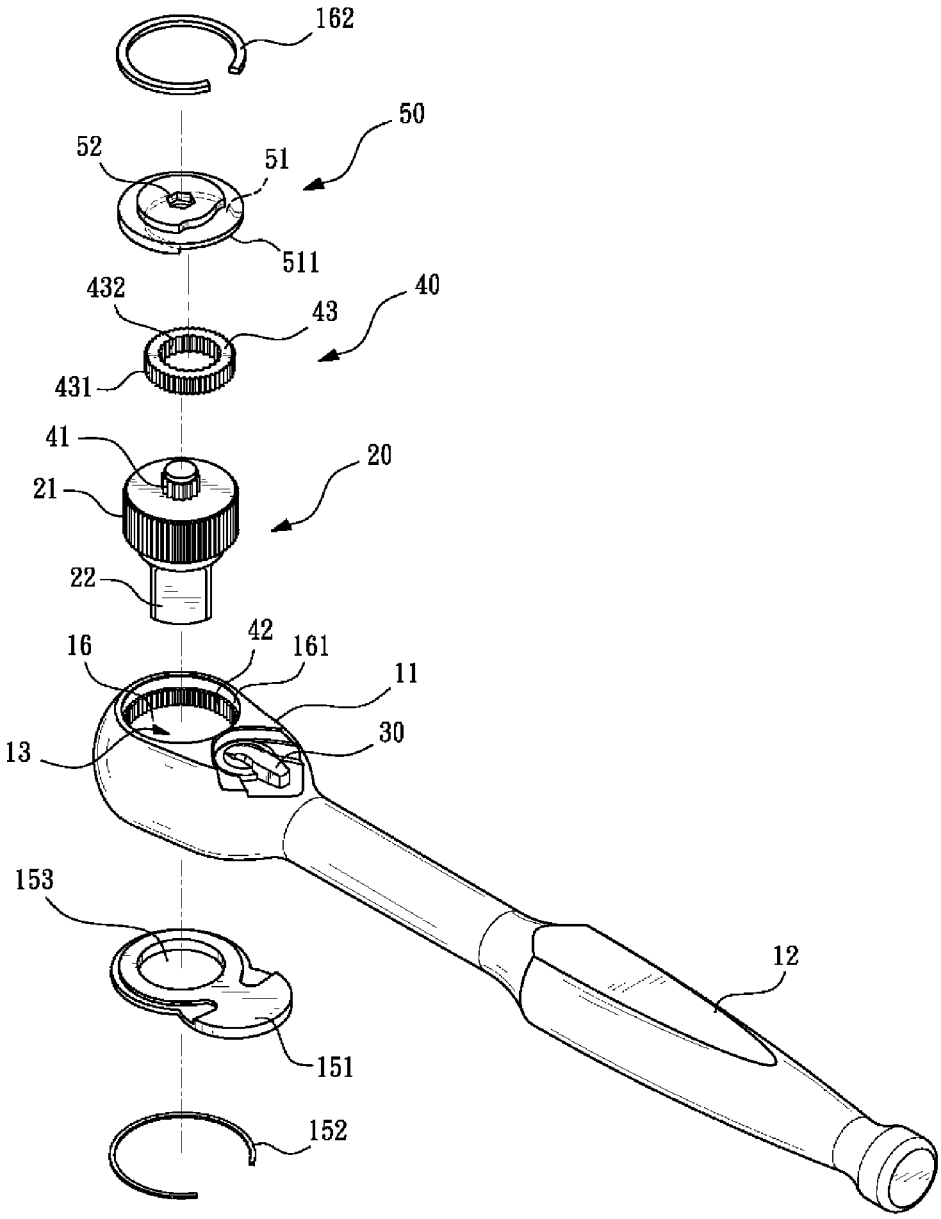
FIG. 2 is an exploded view of the ratchet wrench.
Figure 3:
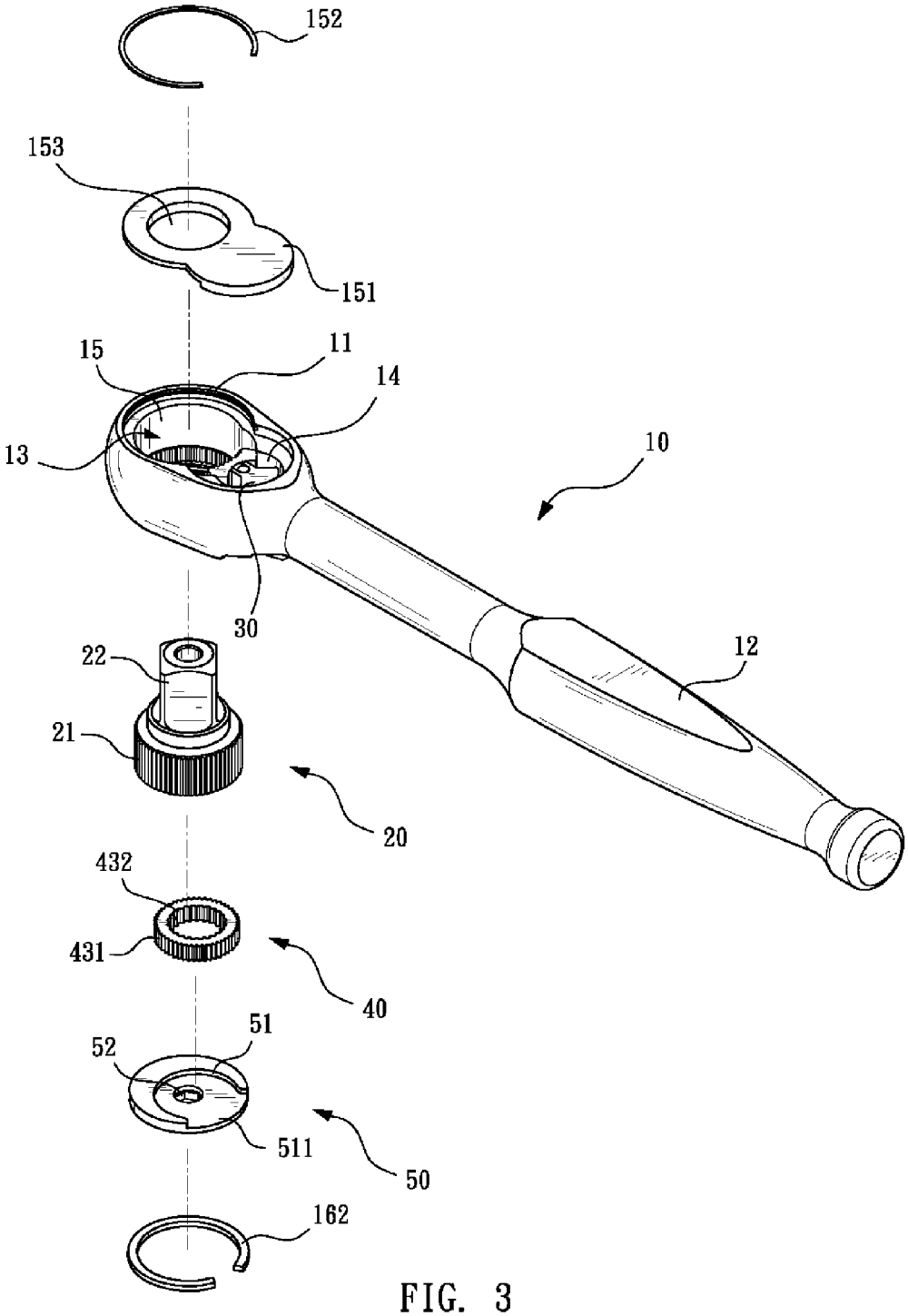
FIG. 3 is another exploded view of the ratchet wrench taken from a different viewpoint.
Figure 4:
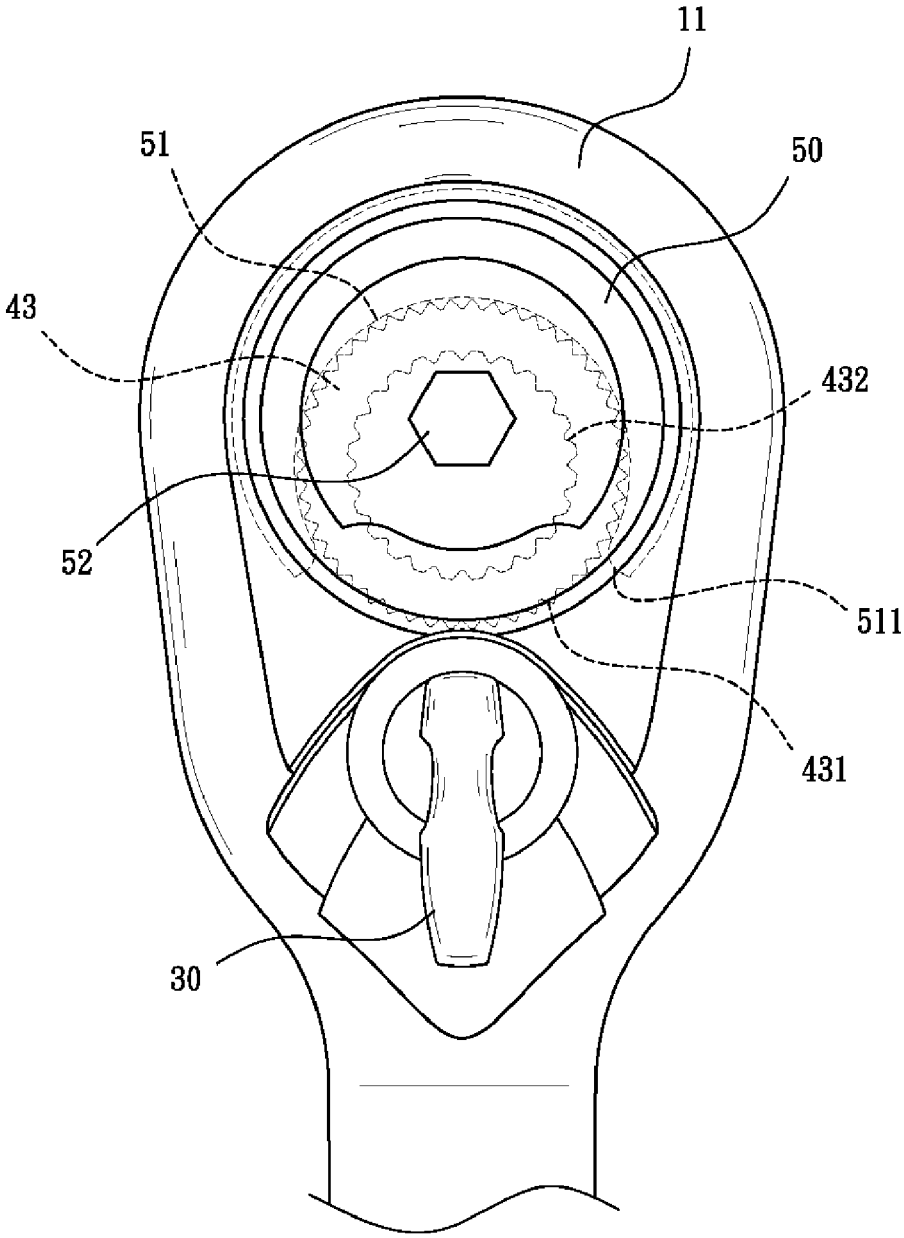
FIG. 4 is partial plane view of the ratchet wrench.

Please refer to FIG. 1 through FIG. 4 for one embodiment of the present invention. As depicted, a ratchet wrench is composed of a wrench body 10, a driving ratchet 20, a direction controller 30, a change-gear set 40, a retaining lid 50 and a positioning rod 60, which will be described in detail below.

The wrench body 10 has a head portion 11 and a shank 12. The head portion 11 contains a ratchet socket 13 and the ratchet socket 13 further includes a switching bay 14. The ratchet socket 13 forms a first opening 15 and a second opening 16 at two reverse sides of the head portion 11, respectively. The first opening 15 is covered by a cover 151 that is fixed at the first opening 15 through a C ring 152. The cover 151 is formed with an operating hole 153.

The driving ratchet 20 has a wheel portion 21 received in the ratchet socket 13 and a connecting portion 22 that is jutting out of the head portion 11 through the operating hole 153 for engaging a tool part, such as a socket.

The direction controller 30 is installed in the switching bay 14 for being operated to set the driving ratchet 20 for performing unidirectional rotation with respect to the head portion 11.

The change-gear set 40 has a passive gear 41, a toothed periphery 42 and a toothed driving ring 43.

The passive gear 41 is mounted on the axle center of the wheel portion 21 and fixedly combined with the wheel portion 21.

The toothed periphery 42 circles the channel. The toothed driving ring 43 is deposited around the channel. The toothed driving ring 43 has outer and inner peripheries thereof formed with outer teeth 431 and inner teeth 432, respectively. The outer teeth 431 are configured to match the toothed periphery 42, while the inner teeth 432 are configured to engage with the passive gear 41.

The retaining lid 50 rotatably covers the second opening 16. In one embodiment, a stepped groove 161 is formed at a periphery of the second opening 16 for a C ring 162 to engage therewith so that the retaining lid 50 is rotatably held at the second opening 16. The retaining lid 50 further has its inner side formed with a positioning recess 51 for receiving the toothed driving ring 43. In addition, the retaining lid 50 is formed with a positioning hole 52. The positioning recess 51 is eccentrically formed on the retaining lid 50, and the positioning recess 51 has an open surface 511 facing the toothed periphery 42, for accommodating the engaged toothed driving ring 43 and the toothed periphery 42.

The positioning rod 60 is an L-shaped rod having a hexagonal cross-sectional profile, and the positioning hole 52 is a hexagonal hole, so that one end of the positioning rod 60 can be fittingly received in the positioning hole 52 in a removable manner to prevent the toothed driving ring 43 from rotating.

Therein, a number of teeth formed on the toothed periphery 42 is greater than a number of the outer teeth 431 that is greater than a number of the inner teeth 432 that is greater than a number of teeth formed on the passive gear 41.

After illustrating the configuration of the certain embodiment of the present invention, the following description will be directed to the operational principles of the present invention.

Figure 5:
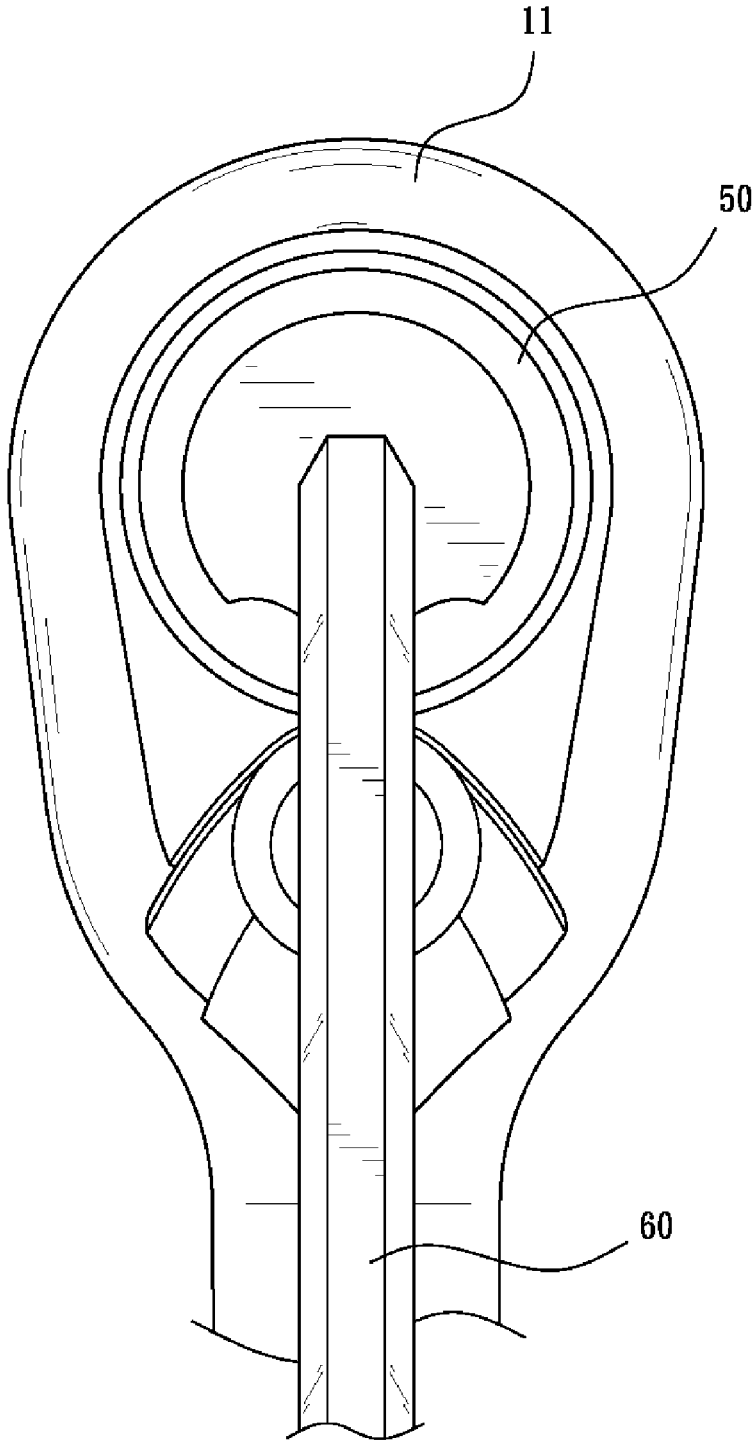
FIG. 5 shows a positioning rod combined with the ratchet wrench.
Figure 6:
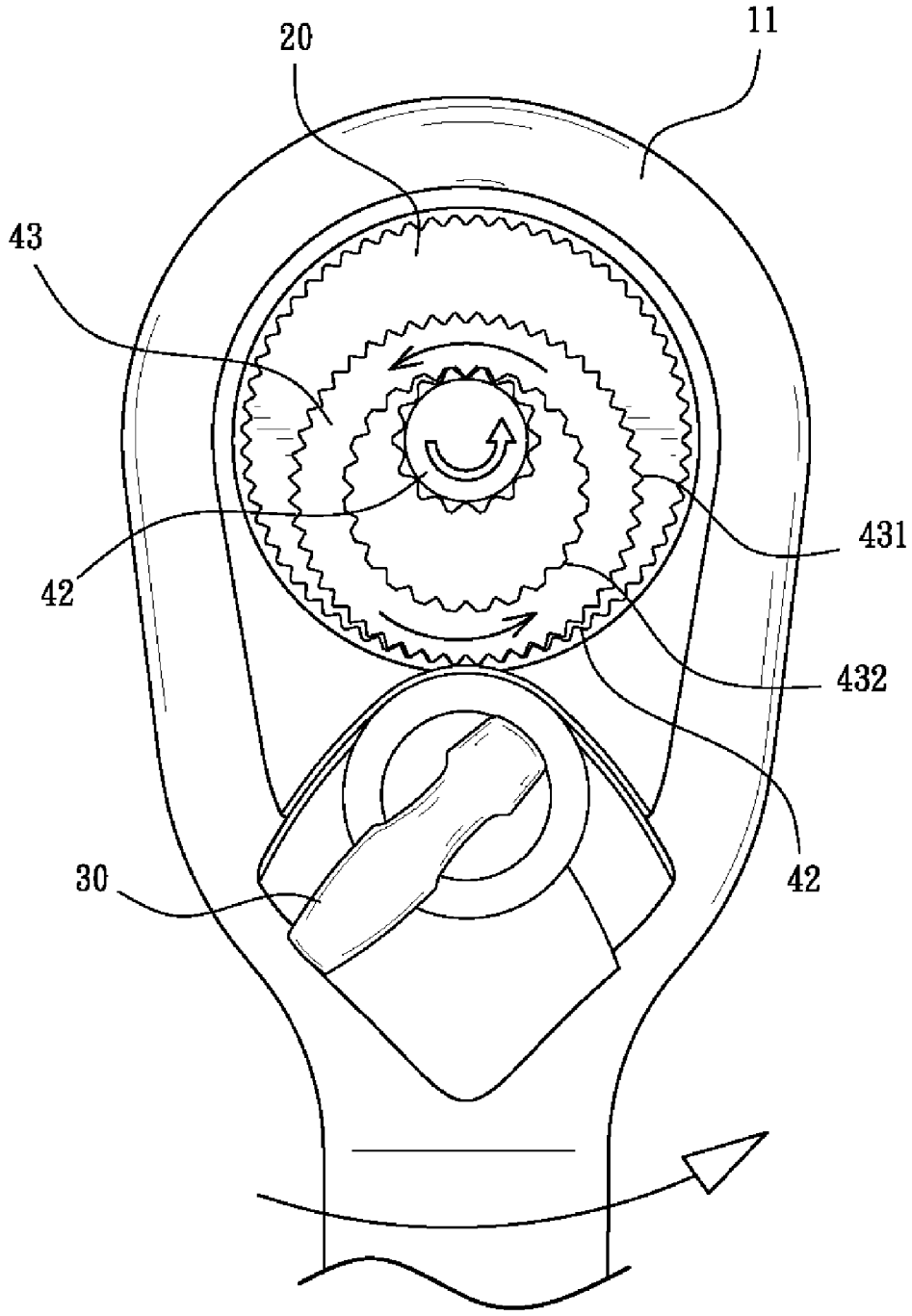
FIG. 6 and FIG. 7 illustrate operation of a direction controller of the ratchet wrench

As shown in FIG. 5, when a user rotates the wrench body 10 in one direction and hold the positioning rod 60 still, since the retaining lid 50 is held from rotating by the positioning rod 60, a relative rotation takes place between the head portion 11 of the wrench body 10 and the retaining lid 50. Thereby, the toothed periphery 42 drives the toothed driving ring 43 to rotate in the positioning recess 51 and in turn drives the passive gear 41 and the driving ratchet 20. Because the outer teeth 431 engage with the toothed periphery 42, the toothed driving ring 43 is driven to rotate with the toothed periphery 42 (e.g. in the anti-clockwise direction as shown in FIG. 6). The inner teeth 432 engaging with the passive gear 41 also make the passive gear 41 to rotate with the toothed driving ring 43 (in the anti-clockwise direction). Then the driving ratchet 20 drives the tool part to rotate in the direction where the wrench body 10 is driven by the user.

Working with the speed-changing function of the change-gear set 40, the gear ratios between the toothed periphery 42, the set of the outer teeth 431, the set of the inner teeth 432 and the passive gear 41 designed for rotational acceleration can further speed up the rotation of the tool part.

Figure 7:
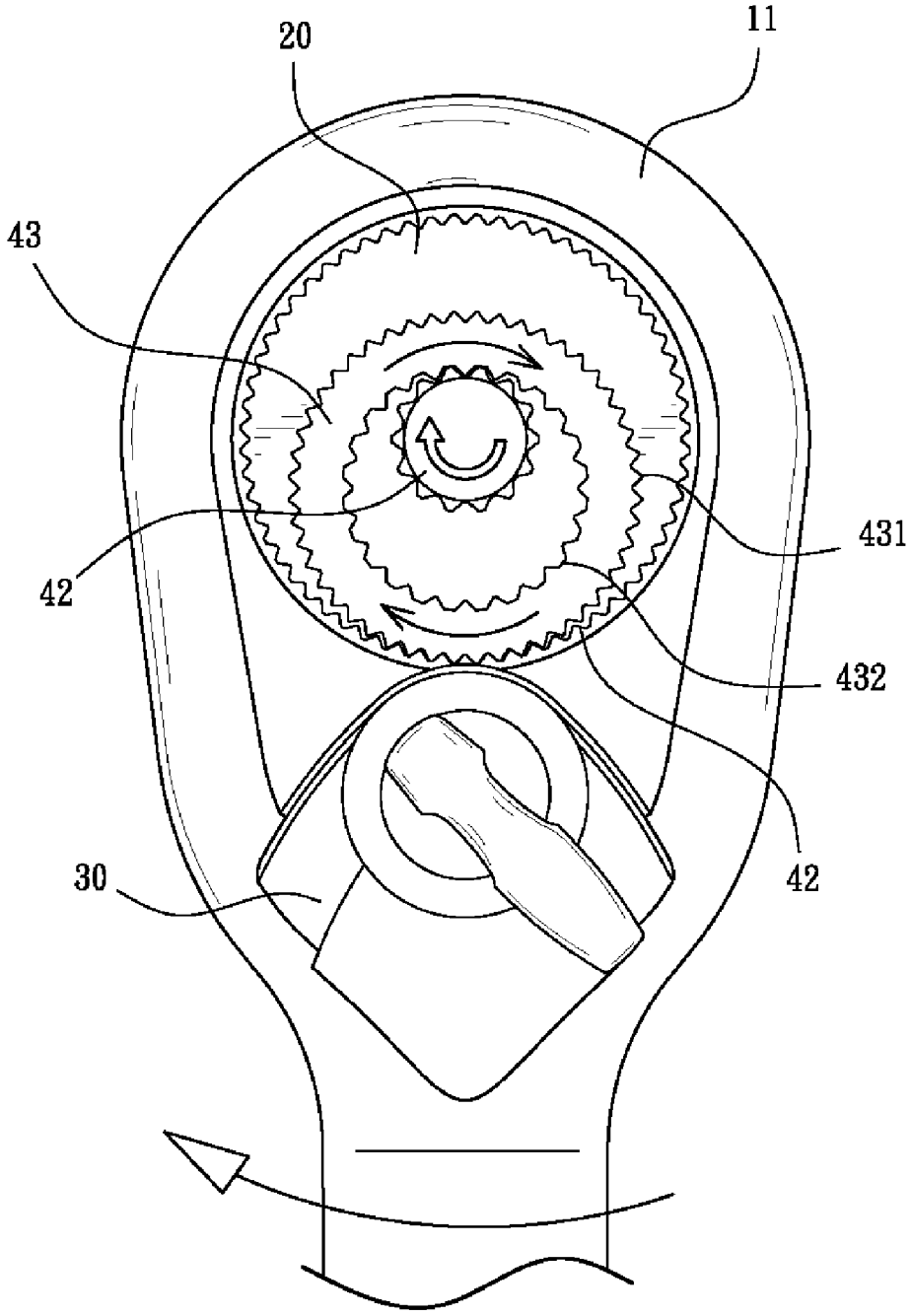

On the other hand, as shown in FIG. 7, when it is desired to operate the wrench body 10 in the clockwise direction, the direction controller 30 is first operated to switch the unidirectional rotation of the driving ratchet 20. Then the positioning rod 60 can be similarly held still to fix the retaining lid 50, so the user's rotating the wrench body 10 in the clockwise direction will drive the driving ratchet 20 and make the tool part to rotate in the clockwise direction.

As described previously, the present invention implements a simple structure where the passive gear 41 is fixedly mounted on the wheel portion 21 and the toothed periphery 42 is essentially a part of the periphery defining the channel. As compared with the existing ratchet wrenches featuring for speed change, the present invention significantly reduces the number of components, and as compared with normal ratchet wrenches, only the toothed driving ring 43 and the retaining lid 50 are added. Thus, the disclosed wrench is easy to manufacture, fabricate and maintain.

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A ratchet wrench, comprising:

a wrench body having a head portion and a shank, the head portion containing a ratchet socket, wherein the ratchet socket forms a first opening and a second opening at two reverse sides of the head portion connected by a channel;

a driving ratchet having a wheel portion received in the ratchet socket and a connecting portion jutting out of the head portion through the first opening;

a change-gear set having a passive gear mounted on an axle center of the wheel portion, said passive gear being disposed offset and on an upper surface of the wheel portion, . . . and the outer teeth are configured to mesh the toothed periphery, while the inner teeth are configured to engage with the passive gear;

a retaining lid rotatably covering the second opening, having a positioning recess for receiving the toothed driving ring, and having a positioning hole; and a positioning rod, being movably received in the positioning hole.

2. The ratchet wrench of claim 1, wherein the positioning recess has an open surface facing the toothed periphery for accommodating the engaged toothed driving ring and the toothed periphery.

3. The ratchet wrench of claim 2, wherein the positioning recess is eccentrically formed on the retaining lid.

4. The ratchet wrench of claim 1, wherein a stepped groove is formed at a periphery of the second opening for a C ring to engage therewith so that the retaining lid is rotatably held in position by the C ring at the second opening.

5. The ratchet wrench of claim 1, wherein the positioning rod is an L-shaped rod having a hexagonal cross-sectional profile, and the positioning hole is a hexagonal hole.

6. The ratchet wrench of claim 1, wherein a number of teeth formed on the toothed periphery is greater than a number of the outer teeth.

7. The ratchet wrench of claim 6, wherein the number of the outer teeth is greater than a number of the inner teeth.

8. The ratchet wrench of claim 7, wherein the number of the inner teeth is greater than a number of teeth formed on the passive gear.

9. The ratchet wrench of claim 1, wherein the ratchet socket further includes a switching bay and a direction controller is installed in the switching bay for being operated to set the driving ratchet for performing unidirectional rotation with respect to the head portion.

* * * * *